US011358396B2

(12) United States Patent
Kakui et al.

(10) Patent No.: US 11,358,396 B2
(45) Date of Patent: Jun. 14, 2022

(54) PRINTER

(71) Applicant: SATO HOLDINGS KABUSHIKI KAISHA, Tokyo (JP)

(72) Inventors: Yasuyuki Kakui, Saitama (JP); Takayoshi Jinnouchi, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 266 days.

(21) Appl. No.: 16/609,519

(22) PCT Filed: Sep. 25, 2018

(86) PCT No.: PCT/JP2018/035523
§ 371 (c)(1),
(2) Date: Oct. 30, 2019

(87) PCT Pub. No.: WO2020/012673
PCT Pub. Date: Jan. 16, 2020

(65) Prior Publication Data

US 2021/0354479 A1 Nov. 18, 2021

(30) Foreign Application Priority Data

Jul. 13, 2018 (JP) ..... JP2018-133724

(51) Int. Cl.
*B41J 2/32* (2006.01)
*B41J 2/325* (2006.01)
*B41J 33/16* (2006.01)

(52) U.S. Cl.
CPC ..... *B41J 2/325* (2013.01); *B41J 33/16* (2013.01)

(58) Field of Classification Search
CPC ... B41J 2/325; B41J 33/16; B41J 17/00; B41J 17/22; B41J 17/24; B41J 33/00; B41J 33/14
See application file for complete search history.

(56) References Cited

U.S. PATENT DOCUMENTS 5,601,373 A 2/1997 Fox
6,053,648 A 4/2000 Mistyurik
(Continued)

FOREIGN PATENT DOCUMENTS

CN 106232372 A 12/2016
EP 0 410 396 A2 1/1991
(Continued)

OTHER PUBLICATIONS

Machine translation of JP 63-170058, published on Jul. 1988. (Year: 1988).*

(Continued)

*Primary Examiner* — Kristal Feggins
(74) *Attorney, Agent, or Firm* — Foley & Lardner LLP

(57) ABSTRACT

A printer includes, a casing, a cover provided swingably, the cover covering an opening portion of the casing, a printing portion configured to print on a print medium, a ribbon supply shaft configured to hold an ink ribbon to be supplied to the printing portion, and a printing unit provided swingably, in a state where the printing unit is accommodated in the cover, rotation of the ribbon supply shaft is permitted, and when the open end side of the printing unit is separated from the cover and the ribbon supply shaft is placed at a ribbon replacement position where the ink ribbon is attachable and detachable, the rotation of the ribbon supply shaft is regulated.

16 Claims, 9 Drawing Sheets

(56) References Cited

U.S. PATENT DOCUMENTS

| | | | | |
|---|---|---|---|---|
| 8,882,371 | B2 | 11/2014 | Chen et al. | |
| 9,067,447 | B2 * | 6/2015 | Suzuki | B41J 2/325 |
| 2003/0047635 | A1 | 3/2003 | Hiraoka et al. | |
| 2009/0279932 | A1 | 11/2009 | Kuo et al. | |
| 2010/0309275 | A1 * | 12/2010 | Kokuta | B41J 2/325<br>347/197 |
| 2015/0145941 | A1 | 5/2015 | Gao et al. | |
| 2015/0165802 | A1 | 6/2015 | Wong et al. | |
| 2020/0047518 | A1 * | 2/2020 | Kakui | B41J 17/24 |
| 2020/0130365 | A1 * | 4/2020 | Maeda | B41J 2/325 |
| 2020/0198381 | A1 * | 6/2020 | Maeda | B65H 16/06 |
| 2021/0354490 | A1 | 11/2021 | Kakui et al. | |

FOREIGN PATENT DOCUMENTS

| | | | | | |
|---|---|---|---|---|---|
| EP | 3822088 | A1 * | 5/2021 | | B41J 17/32 |
| JP | 61-128052 | U | 8/1986 | | |
| JP | 63-170058 | * | 7/1988 | | B41J 17/32 |
| JP | 2003-080783 | A | 3/2003 | | |
| JP | 2004-142113 | A | 5/2004 | | |
| JP | 2009-179010 | A | 8/2009 | | |
| JP | 2009-286000 | A | 12/2009 | | |

OTHER PUBLICATIONS

USPTO Office Action, U.S. Appl. No. 16/609,315, dated Dec. 9, 2021, 13 pages.
Japanese Office Action, Application No. 2019-545143, dated Jan. 25, 2022, 6 pages.
USPTO Notice of Allowance, U.S. Appl. No. 16/609,315, dated Mar. 24, 2022, 9 pages.

* cited by examiner

PRINTER

TECHNICAL FIELD

The present invention relates to a printer.

BACKGROUND ART

JP2009-179010A discloses a printer including a swingably provided printing unit. A ribbon supply shaft that holds an ink ribbon and a ribbon roll up shaft that rolls up the used ink ribbon are provided in the printing unit.

The above printer also includes a stopper that stops the printing unit in a state where the ink ribbon is attachable to and detachable from the ribbon supply shaft when the printing unit is swung.

SUMMARY OF INVENTION

In the above printer, for example, it is thought that the ribbon supply shaft is rotated in reaction of stoppage of the printing unit and the ink ribbon is loosened at the time of replacing the ink ribbon. When the ink ribbon is loosened at the time of replacing the ink ribbon in such a way, there is a problem that a task of replacing the ink ribbon is less easily performed.

The present invention is achieved in consideration with such a technical problem, and an object of the present invention is to provide a printer in which an ink ribbon is easily replaced.

According to an aspect of the present invention, a printer including a casing, a cover provided swingably, the cover covering an opening portion of the casing, a printing portion configured to print on a print medium, a ribbon supply shaft configured to hold an ink ribbon to be supplied to the printing portion, a ribbon roll up shaft configured to roll up the ink ribbon used in the printing portion, and a printing unit provided swingably, the printing unit having a thermal head that constitutes the printing portion, wherein the ribbon supply shaft and the ribbon roll up shaft are provided in the printing unit, in a state where the printing unit is accommodated in the cover, rotation of the ribbon supply shaft is permitted, and when the open end side of the printing unit is separated from the cover and the ribbon supply shaft is placed at a ribbon replacement position where the ink ribbon is attachable and detachable, the rotation of the ribbon supply shaft is regulated is provided.

With this aspect, in a state where the open end side of the printing unit is separated from the cover and the ink ribbon is attachable to and detachable from the ribbon supply shaft, the rotation of the ribbon supply shaft is regulated. Therefore, at the time of replacing the ink ribbon, it is possible to prevent that the ribbon supply shaft is rotated and the ink ribbon is loosened. Thus, it is possible to easily replace the ink ribbon.

DESCRIPTION OF EMBODIMENTS

First Embodiment

Hereinafter, a printer 100 according to a first embodiment of the present invention will be described with reference to the attached drawings.

The printer 100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet.

Figure 1:
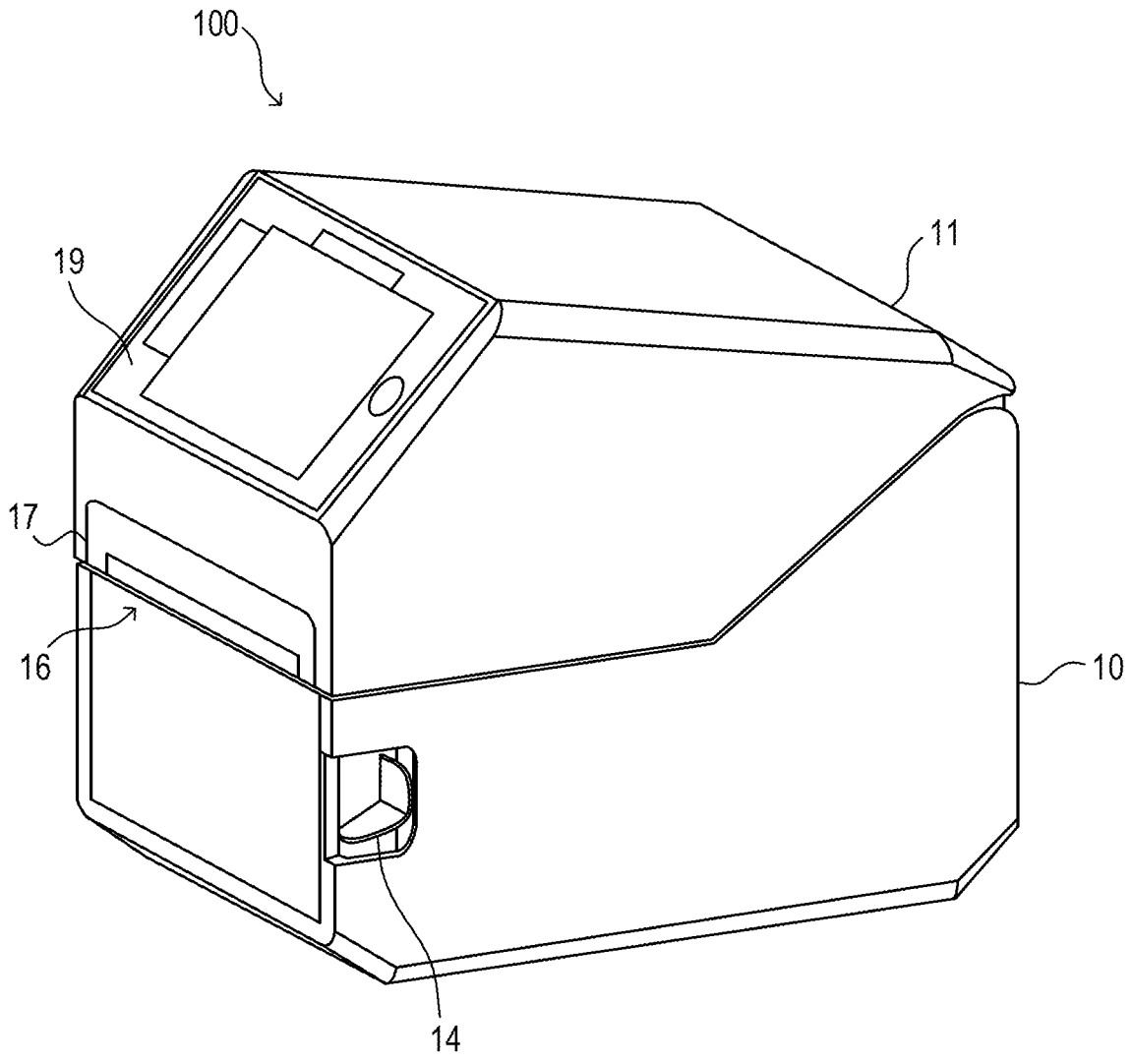
FIG. 1 is a perspective view of a printer according to a first embodiment of the present invention.
Figure 2:
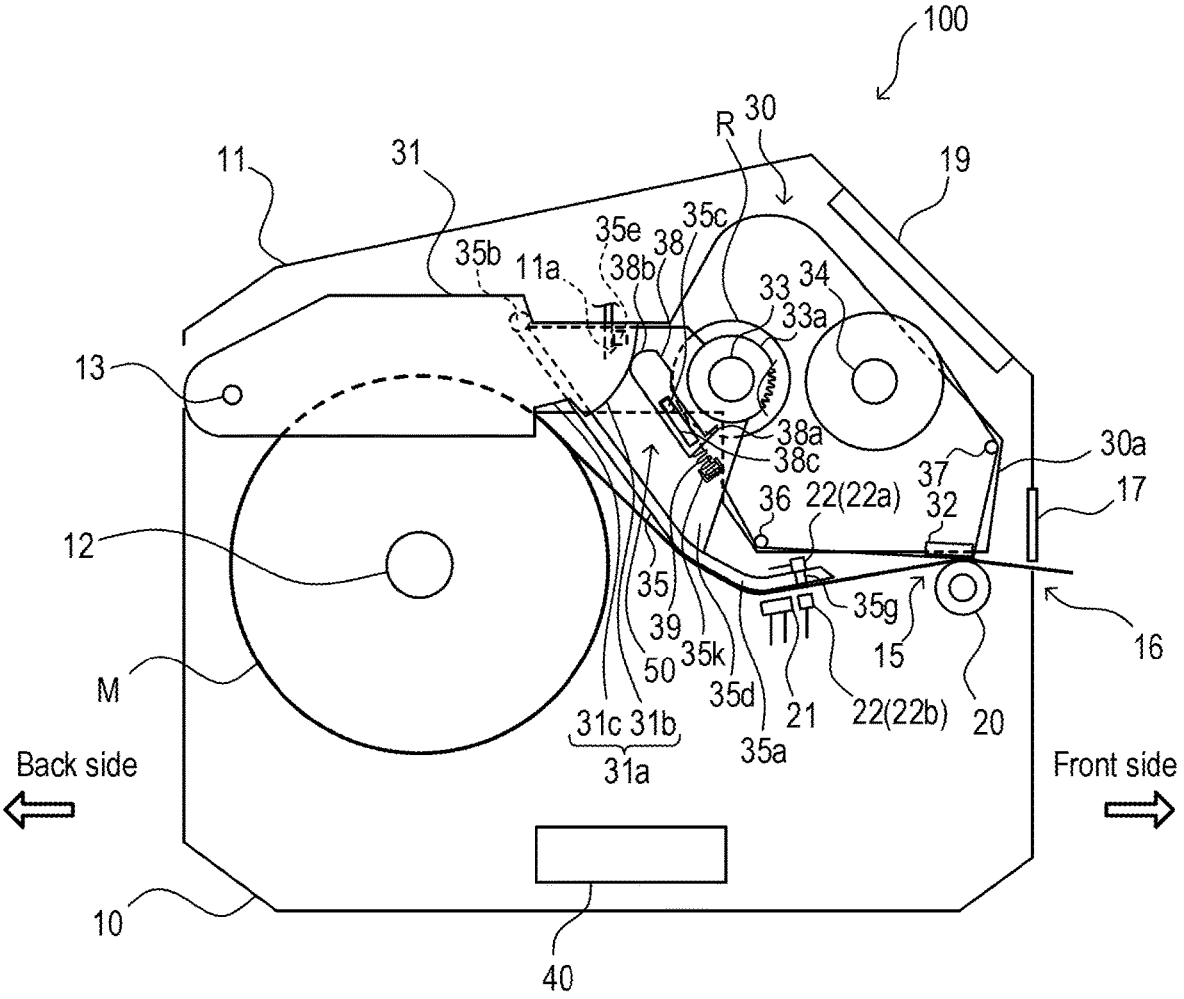
FIG. 2 is a schematic configuration view of the printer.

As shown in FIGS. 1 and 2, the printer 100 includes a casing 10, and a cover 11 that covers an opening portion of the casing 10.

As shown in FIG. 2, the print medium M is held on a medium supply shaft 12 in a state where the print medium is wound in a roll form. As the print medium M, a linerless label or a fanfold medium can also be used.

An end portion of the cover 11 is supported by a support shaft 13 so that the cover 11 is swingable. By swinging with the support shaft 13 as a supporting point, it is possible to switch the cover 11 between an open state where the opening portion of the casing 10 is opened and a close state where the opening portion is closed.

A cover lock mechanism (not shown) that maintains the close state of the cover 11 is provided in the casing 10. The cover lock mechanism is released by operating a lever 14 shown in FIG. 1.

Between an end portion of the cover 11 on the opposite side to the support shaft 13 and the casing 10, an outlet port 16 that discharges the print medium M to which printing is already performed by a printing portion 15 shown in FIG. 2 from the printer 100 is formed.

A cutter 17 facing the outlet port 16 is attached to the cover 11 of the present embodiment. Thereby, it is possible to cut the printed print medium M discharged from the outlet port 16. Note that in the printer 100, it is possible to attach various units, for example, a removal unit that removes labels from a band-shaped liner sheet, and a cutter unit that cuts linerless labels (labels with no band-shaped liner sheet).

An operation unit 19 for operating the printer 100 is also provided in the cover 11. The operation unit 19 has various operation buttons, a display, a near-field communication module, LEDs, etc. The display may be a touch panel.

Inside the printer 100, a printing unit 30 for performing printing to the print medium M, a controller 40 that controls actions of the printer 100, etc. are accommodated.

The printing unit 30 includes a main body portion 31 whose end portion is supported by the support shaft 13 so that the main body portion 31 is swingable, and a thermal head 32 attached to the main body portion 31.

The thermal head 32 constitutes the printing portion 15 that performs printing to the print medium M together with a platen roller 20 provided on the casing 10 side.

The printing unit 30 also includes a ribbon supply shaft 33 that holds the ink ribbon R to be supplied to the printing portion 15 in a roll form, a ribbon roll up shaft 34 that rolls up the used ink ribbon R, and a partition member 35 that partitions the ink ribbon R and the print medium M.

The ribbon supply shaft 33 is detachably attached to the partition member 35. The ribbon roll up shaft 34 is detachably attached to the main body portion 31. Note that the ink ribbon R of the present embodiment is an outside wound ink ribbon in which a surface where inks are applied are on the outside.

The printing unit 30 also includes a guide shaft 36 that defines a feed passage of the ink ribbon R from the ribbon supply shaft 33 to the printing portion 15, and a guide shaft 37 that defines a feed passage of the ink ribbon R from the printing portion 15 to the ribbon roll up shaft 34. Note that the example in which one guide shaft is provided in the upstream of the printing portion 15 and another guide shaft is provided in the downstream will be described. However, for example, one more guide shaft may be provided in the vicinity of the upstream side of the thermal head 32.

The print medium M is supplied from the medium supply shaft 12 to the printing portion 15, and nipped between the thermal head 32 and the platen roller 20 together with the ink ribbon R.

When electricity is distributed through to a heating element of the thermal head 32 in a state where the print medium M and the ink ribbon R are nipped between the thermal head 32 and the platen roller 20, the inks of the ink ribbon R are transferred to the print medium M by heat of the heating element, so that printing is performed to the print medium M.

When the platen roller 20 is rotated forward by a platen drive motor (not shown), the print medium M and the ink ribbon R are fed to the downstream side in the feed direction, and the print medium M is discharged to the outside of the printer 100 from the outlet port 16.

The ribbon roll up shaft 34 is driven and rotated by being coupled with the platen drive motor via a gear 61, etc. (see FIG. 5) when the cover 11 is in the close state. A back tension mechanism (not shown) is provided in the ribbon supply shaft 33, and the ink ribbon R is fed while developing fixed back tension on the upstream side in the feed direction.

As shown in FIG. 2, the partition member 35 has a base portion 35*a*, a shaft portion 35*b* provided on the one end side of the base portion 35*a*, a support portion 35*d* that rotatably supports the ribbon supply shaft 33 in parallel to the shaft portion 35*b*, and an engagement portion 35*e* formed in the support portion 35*d*.

The partition member 35 is swingably supported on the main body portion 31 by the shaft portion 35*b*.

As shown in FIG. 2, the engagement portion 35*e* is configured to be engaged with an engaged portion 11*a* provided in the cover 11. When the partition member 35 is brought to a position (close position) where the engagement portion 35*e* is engaged with the engaged portion 11*a*, the ribbon supply shaft 33 is accommodated in the main body portion 31. Thereby, the ribbon supply shaft 33 is brought to a ribbon supply position (second position) where the ink ribbon R is supplied to the printing portion 15.

In such a way, by engaging the engagement portion 35*e* with the engaged portion 11*a*, the partition member 35 is held at the close position where the ribbon supply shaft 33 is placed at the ribbon supply position. The printing unit 30 and the cover 11 are combined with each other, and the printing unit 30 is held at an accommodation position where the printing unit 30 is accommodated in the cover 11.

At the time of performing printing by the printer 100, the cover 11 is brought into the close state, and the engagement portion 35*e* of the partition member 35 is engaged with the engaged portion 11*a* of the cover 11.

Figure 3:
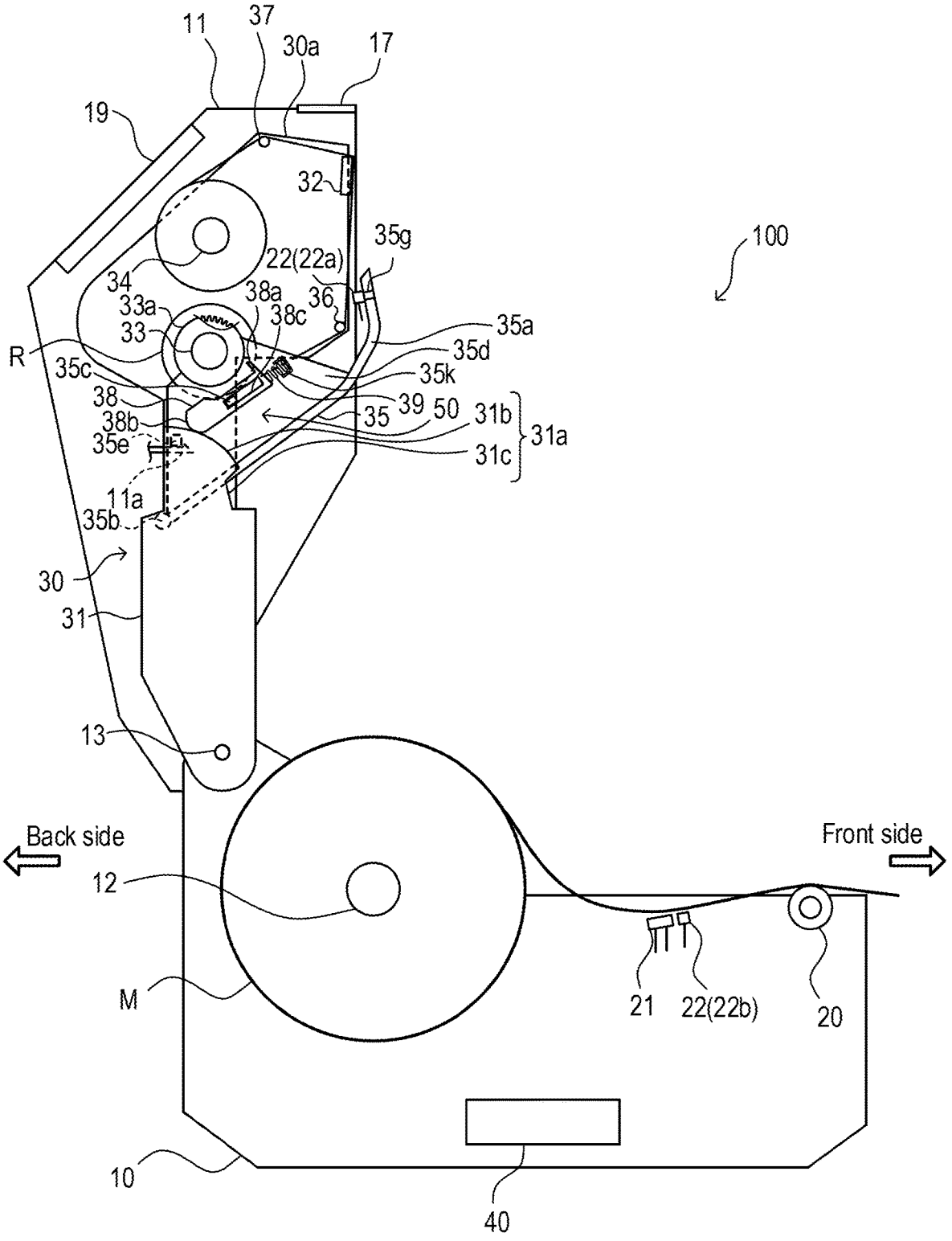
FIG. 3 is a view showing a state where a cover is opened.

Therefore, when the cover 11 is opened, the printing unit 30 is swung integrally with the cover 11, and as shown in FIG. 3, the opening portion of the casing 10 is opened.

Thereby, it is possible to perform settings of the print medium M to the printer 100 and maintenance of portions in the casing 10.

Figure 4:
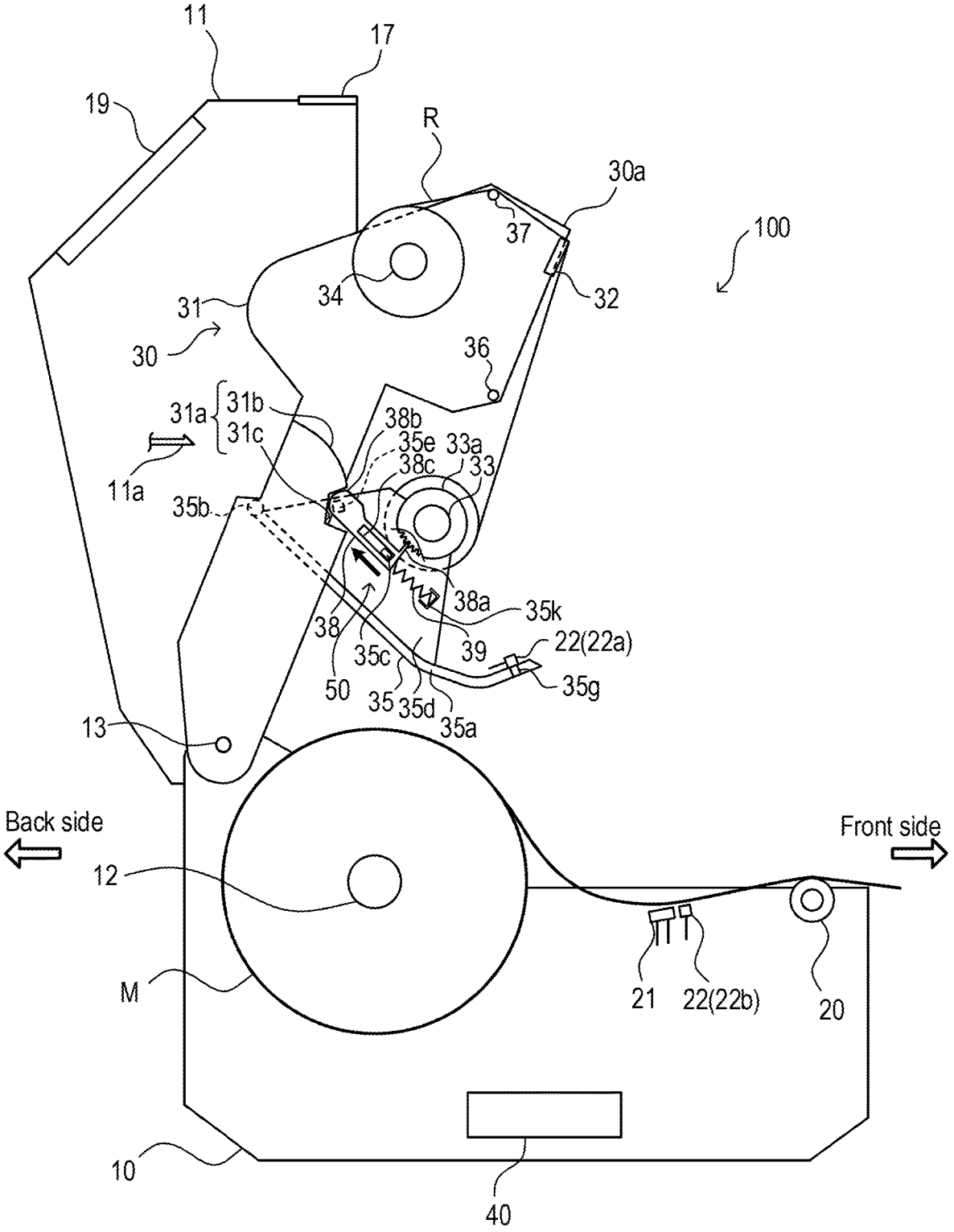
FIG. 4 is a view showing a state where a ribbon supply shaft is placed at a ribbon replacement position.

Further, when engagement between the engagement portion 35*e* and the engaged portion 11*a* is released from the state shown in FIG. 3 and the partition member 35 is swung to the casing 10 side, the partition member 35 is brought to an open position shown in FIG. 4. The base portion 35*a* is abutted with the main body portion 31 of the printing unit 30 and the partition member 35 is stopped at the open position.

When the partition member 35 is swung to the casing 10 side with torque which is predetermined torque or more, the engagement portion 35*e* and the engaged portion 11*a* are elastically deformed and the engagement between the engagement portion 35*e* and the engaged portion 11*a* is released.

Following the state that the partition member 35 is brought to the open position, the ribbon supply shaft 33 attached to the partition member 35 and the roll-form ink ribbon R held by the ribbon supply shaft 33 are moved with respect to the ribbon roll up shaft 34, and exposed to the outlet port 16 side of the print medium M which is the front side of the printer 100.

By releasing the engagement between the engagement portion 35*e* and the engaged portion 11*a*, the printing unit 30 itself is swung to a predetermined position toward the casing 10 side, so that the open end 30*a* side is separated from the cover 11. The predetermined position is a position where a swing regulating portion (not shown) provided in the vicinity of the support shaft 13 in the casing 10 and the main body portion 31 are abutted with each other.

According to this, the ribbon supply shaft 33 is brought to a ribbon replacement position (first position) where the ink ribbon R is attachable and detachable, and it is possible to perform a task of replacing the ink ribbon R.

In such a way, when the partition member 35 is brought to the open position, the open end 30*a* side of the printing unit 30 is separated from the cover 11, and the ribbon supply shaft 33 is brought to the ribbon replacement position where the ink ribbon R is attachable and detachable.

As shown in FIG. 4, at the ribbon replacement position, the ribbon supply shaft 33 is exposed to the front side of the printer 100. Therefore, an operator easily visually confirms the ribbon supply shaft 33 and the task of replacing the ink ribbon R is easily performed.

Note that when the printing unit 30 is swung to the casing 10 side with torque which is predetermined torque or more, the swing regulating portion is elastically deformed, the main body portion 31 goes over the swing regulating portion, and the positioning of the printing unit 30 by the swing regulating portion is released.

In such a way, in the present embodiment, the ribbon supply shaft 33 is movable with respect to the ribbon roll up shaft 34, and at the time of replacing the ink ribbon R, it is possible to move the ribbon supply shaft 33 to the position where the task can be easily performed.

The printer 100 also includes a ribbon supply shaft lock mechanism 50 to be brought into a lock state where rotation of the ribbon supply shaft 33 is regulated when the ribbon supply shaft 33 is placed at the ribbon replacement position, and into a non-lock state where the rotation of the ribbon supply shaft 33 is permitted when the ribbon supply shaft 33 is placed at the ribbon supply position.

The ribbon supply shaft lock mechanism 50 will be described with reference to FIGS. 2 to 4.

The ribbon supply shaft lock mechanism 50 has a gear 33*a* provided in the ribbon supply shaft 33, a lock member (first lock member) 38 provided movably between a meshing position where a claw portion 38*a* and the gear 33*a* mesh with each other (see FIG. 4) and a non-meshing position where meshing between the claw portion 38*a* and the gear 33*a* is released (see FIGS. 2 and 3), a guide rail 31*a* provided in the main body portion 31 of the printing unit 30, the guide rail to be abutted with an end portion 38*b* of the lock member 38, and a spring (first bias member) 39 that biases the lock member 38 toward the guide rail 31*a*.

A long hole 38*c* is formed in the lock member 38, and a rectangular projected portion 35*c* provided in the support portion 35*d* of the partition member 35 is to be fitted into the long hole 38*c*. Thereby, the lock member 38 is slidably supported by the projected portion 35*c*, and becomes movable between the meshing position and the non-meshing position along the longitudinal direction of the long hole 38*c*.

The spring 39 is provided in a compressed state between a sheet portion 35*k* provided in the support portion 35*d* of the partition member 35 and the lock member 38, and biases the lock member 38 toward the guide rail 31*a*. Note that in the present embodiment, the spring 39 is a coil spring. The bias member that biases the lock member 38 may be a plate spring, a torsional spring, rubber, etc.

The guide rail 31*a* has a guide surface 31*b* formed in an arc of a circle whose center is the shaft portion 35*b* of the partition member 35, and a guide surface 31*c* formed at a position closer to the shaft portion 35*b* than the guide surface 31*b*.

Following the state that the partition member 35 is swung between the close position and the open position, the lock member 38 biased by the spring 39 slides along the guide surfaces 31*b* and 31*c*.

The guide surface 31*b* is formed in an arc of a circle whose center is the shaft portion 35*b* of the partition member 35. Thus, in a case where the partition member 35 is swung within a range where the lock member 38 slides along the guide surface 31*b*, a position of the lock member 38 with respect to the gear 33*a* provided in the ribbon supply shaft 33 is not changed. In this case, as shown in FIGS. 2 and 3, the lock member 38 is maintained at the non-meshing position.

When the partition member 35 is swung to the open position, the lock member 38 is moved to a position to oppose the guide surface 31*c*. Thereby, as shown by an arrow in FIG. 4, the lock member 38 is moved to a position where the lock member 38 is biased by the spring 39 and abutted with the guide surface 31*c*, and brought to the meshing position where the claw portion 38*a* meshes with the gear 33*a*. In this state, the rotation of the ribbon supply shaft 33 is regulated by the lock member 38.

When the partition member 35 is swung from the open position to the close position, the lock member 38 goes up onto the guide surface 31*b* while compressing the spring 39. Thereby, the lock member 38 is brought to the non-meshing position where the meshing between the claw portion 38*a* and the gear 33*a* is released. In this state, the rotation of the ribbon supply shaft 33 is permitted.

Therefore, in a state where the partition member 35 is placed at the close position and the printing unit 30 and the cover 11 are combined with each other, that is, in a state where the printing unit 30 is placed at the accommodation position where the printing unit 30 is accommodated in the cover 11, the rotation of the ribbon supply shaft 33 is permitted.

The ribbon supply shaft lock mechanism 50 is configured as described above, and switched between the lock state where the rotation of the ribbon supply shaft 33 is regulated and the non-lock state where the rotation of the ribbon supply shaft 33 is permitted in conjunction with the swing actions of the partition member 35.

In such a way, in the printer 100, when the partition member 35 is brought to the open position, that is, when the ribbon supply shaft 33 is placed at the ribbon replacement position (first position), the ribbon supply shaft lock mechanism 50 is brought into the lock state where the rotation of the ribbon supply shaft 33 is regulated. When the partition member 35 is brought to the close position, that is, when the ribbon supply shaft 33 is placed at the ribbon supply position (second position), the ribbon supply shaft lock mechanism 50 is brought into the non-lock state where the rotation of the ribbon supply shaft 33 is permitted.

In other words, in a state where the printing unit 30 is accommodated in the cover 11, the rotation of the ribbon supply shaft 33 is permitted. When the open end 30*a* side of the printing unit 30 is separated from the cover 11 and the ribbon supply shaft 33 is placed at the ribbon replacement position where the ink ribbon R is attachable and detachable, the rotation of the ribbon supply shaft 33 is regulated.

Therefore, at the time of replacing the ink ribbon R, it is possible to prevent that the ribbon supply shaft 33 is rotated in reaction of stoppage of the partition member 35 at the open position and the ink ribbon R is loosened, and that the ribbon supply shaft 33 is rotated during the task of replacing the ink ribbon R and the ink ribbon R is loosened. Thus, it is possible to easily replace the ink ribbon R.

The ribbon supply shaft lock mechanism 50 is automatically switched between the lock state and the non-lock state in conjunction with the swing actions of the partition member 35.

Therefore, there is no need for operating the ribbon supply shaft lock mechanism 50 in order to regulate the rotation of the ribbon supply shaft 33, and it is possible to efficiently perform the task of replacing the ink ribbon R.

As shown in FIG. 4, the claw portion 38*a* of the lock member 38 is moved in the tangent line direction in the vicinity of a tangent line of an outer diameter of the gear 33*a* and meshes with the gear 33*a*.

Note that in the present embodiment, in a state where the lock member 38 is placed at the meshing position, the claw portion 38*a* meshes with the gear 33*a* provided in the ribbon supply shaft 33. However, the claw portion 38*a* may mesh with another gear coupled to the ribbon supply shaft 33. The phrase that "a gear is coupled to the ribbon supply shaft 33" indicates the state that rotation of the gear is transmitted to the ribbon supply shaft 33. Therefore, the gear 33*a* is also a gear coupled to the ribbon supply shaft 33.

Note that the printer 100 includes a clutch mechanism (not shown) in which the ribbon supply shaft 33 is rotated upon application of torque which is predetermined torque or more even when the ribbon supply shaft lock mechanism 50 is in the lock state. Therefore, for example, in a case where large tensile force is applied to the ink ribbon R in the ribbon roll-up direction, the ribbon supply shaft 33 is rotated. Thus, it is possible to prevent breakage of the ink ribbon R.

Figure 5:
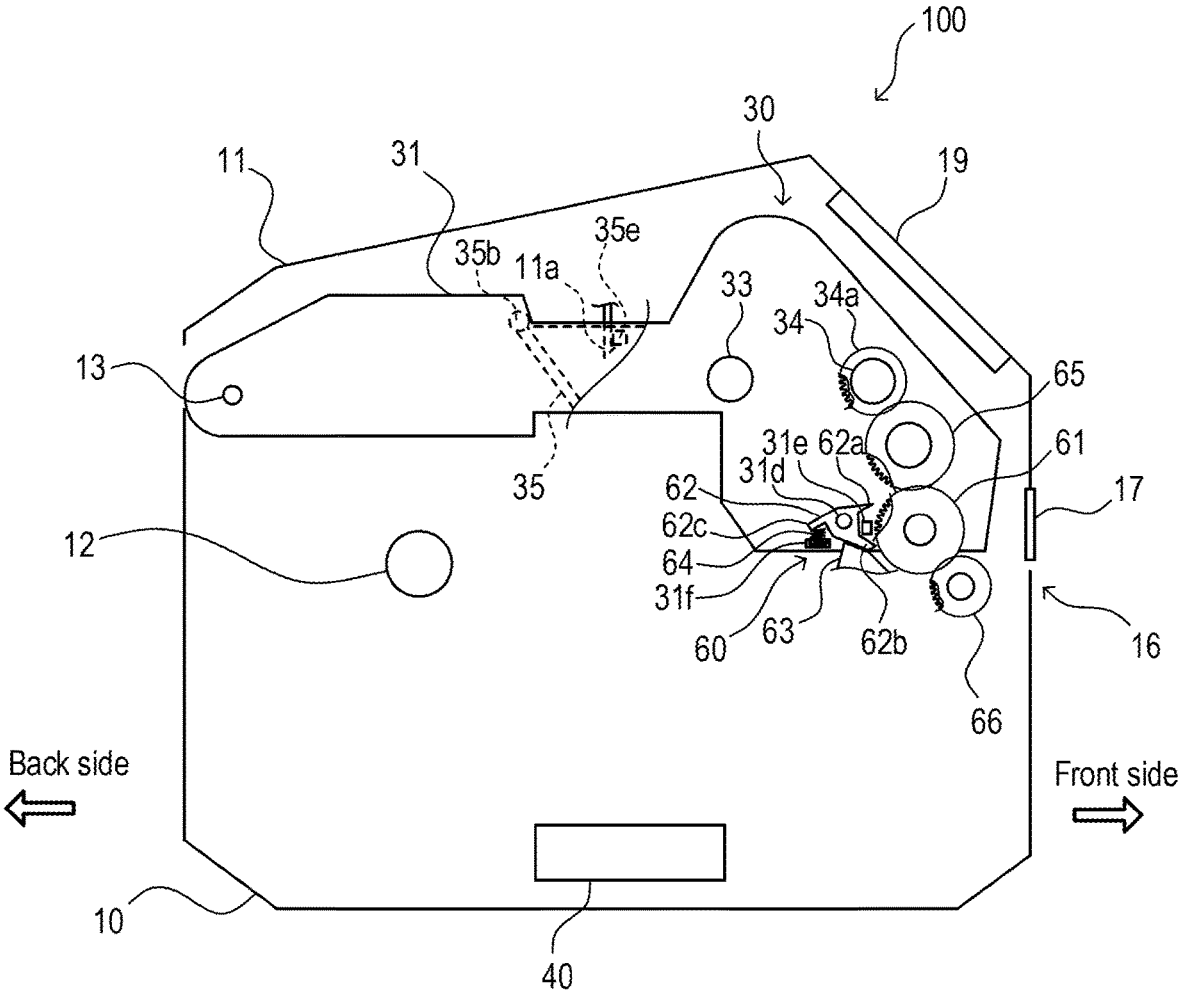
FIG. 5 is a view for explaining a ribbon roll up shaft lock mechanism.
Figure 6:
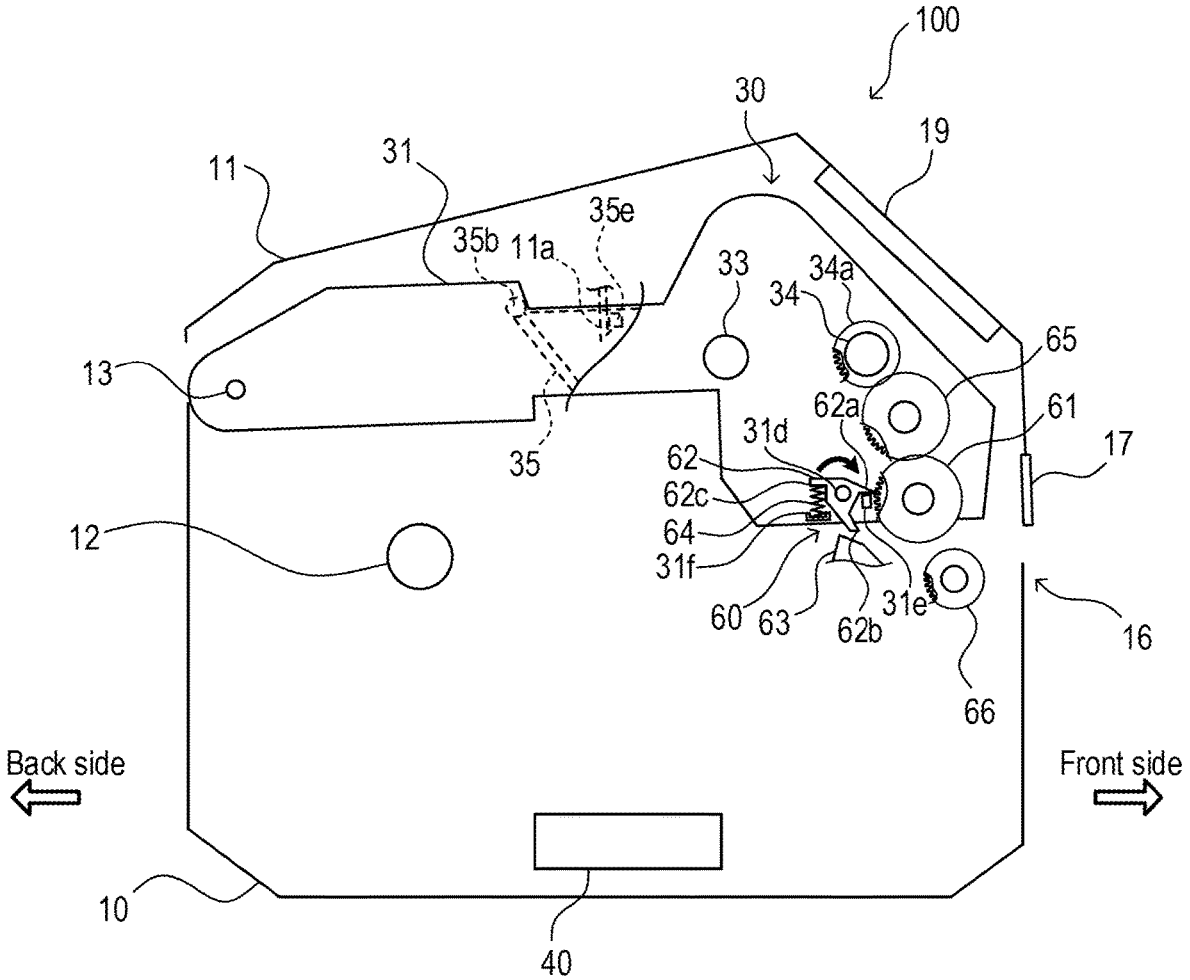
FIG. 6 is a view showing the ribbon roll up shaft lock mechanism in a lock state.

As shown in FIGS. 5 and 6, the printer 100 also includes a ribbon roll up shaft lock mechanism 60 to be brought into a lock state where rotation of the ribbon roll up shaft 34 is regulated when the cover 11 is opened, and into a non-lock state where the rotation of the ribbon roll up shaft 34 is permitted when the cover 11 is closed. In FIGS. 5 and 6, some configurations of the printer 100 are appropriately omitted for easy understanding.

The ribbon roll up shaft lock mechanism 60 has the gear 61 provided in the main body portion 31 of the printing unit 30 and coupled to the ribbon roll up shaft 34, a lock member (second lock member) 62 supported by a support shaft 31*d* provided in the main body portion 31 of the printing unit 30, the lock member being provided turnably between a meshing position where a claw portion 62*a* and the gear 61 mesh with each other (see FIG. 6) and a non-meshing position where meshing between the claw portion 62*a* and the gear 61 is released (see FIG. 5), a first positioning portion 63 provided on the casing 10 side, the first positioning portion to be abutted with a projected portion 62*b* of the lock member 62 to position the lock member 62 at the non-meshing position, a second positioning portion 31*e* provided in the main body portion 31 of the printing unit 30, the second positioning portion to be abutted with the claw portion 62*a* of the lock member 62 to position the lock member 62 at the meshing position, and a spring (second bias member) 64 that biases the lock member 62 in the direction in which the lock member is turned from the non-meshing position toward the meshing position.

The spring 64 is provided in a compressed state between a sheet portion 31*f* provided in the main body portion 31 of the printing unit 30 and a projected portion 62*c* of the lock member 62, and biases the lock member 62 in the direction in which the lock member is turned from the non-meshing position toward the meshing position. Note that in the present embodiment, the spring 64 is a coil spring. The bias member that biases the lock member 62 may be a plate spring, a torsional spring, rubber, etc.

The gear 61 meshes with a gear 65 provided in the main body portion 31. The gear 65 meshes with a gear 34*a* provided in the ribbon roll up shaft 34. That is, the gear 61 is coupled to the ribbon roll up shaft 34 via the gear 65 and the gear 34*a*. The phrase that "a gear is coupled to the ribbon roll up shaft 34" indicates the state that rotation of the gear is transmitted to the ribbon roll up shaft 34.

As shown in FIG. 5, in a case where the cover 11 is in the close state, the gear 61 meshes with a gear 66 provided on the casing 10 side.

In a case where the cover 11 is in the close state, the projected portion 62*b* is abutted with the first positioning portion 63, and hence a turn in the direction to the meshing position is regulated, so that the lock member 62 is positioned at the non-meshing position. In this state, the lock member 62 permits the rotation of the ribbon roll up shaft 34.

Therefore, in a case where the cover 11 is in the close state, and when drive force of the platen drive motor is transmitted to the gear 66, the ribbon roll up shaft 34 is rotated via the gears 61, 65, and 34*a*.

When the lever 14 is operated and the cover 11 is opened, as shown in FIG. 6, the printing unit 30 is swung integrally with the cover 11. Following this, the lock member 62 provided in the printing unit 30 is also moved upward to be separated from the first positioning portion 63. At this time, the lock member 62 is turned in the direction to the meshing position by bias force of the spring 64.

Thereby, when the cover 11 is opened, the lock member 62 is brought to the meshing position where the claw portion 62*a* is abutted with the second positioning portion 31*e*. In this state, the rotation of the ribbon roll up shaft 34 is regulated by the lock member 62.

In such a way, when the cover 11 is opened, the ribbon roll up shaft lock mechanism 60 is brought into the lock state where the rotation of the ribbon roll up shaft 34 is regulated.

On the other hand, when the cover 11 is closed, the projected portion 62*b* is abutted with the first positioning portion 63, and hence the lock member 62 is turned in the direction to the non-meshing position while compressing the spring 64. Thereby, the ribbon roll up shaft lock mechanism 60 is brought into the non-lock state.

The ribbon roll up shaft lock mechanism 60 is brought into the lock state when the cover 11 is opened. Thus, when the ribbon supply shaft 33 is placed at the ribbon replacement position, the rotation of the ribbon roll up shaft 34 is regulated.

In such a way, in the present embodiment, when the ribbon supply shaft 33 is placed at the ribbon replacement position where the ink ribbon R is attachable and detachable, the rotation of the ribbon supply shaft 33 and the rotation of the ribbon roll up shaft 34 are regulated. Therefore, at the time of replacing the ink ribbon R, it is possible to prevent that the ribbon supply shaft 33 is rotated and the ink ribbon R is loosened. As described above, the back tension mechanism is provided in the ribbon supply shaft 33. Therefore, when the ribbon supply shaft 33 is placed at the ribbon replacement position where the ink ribbon R is attachable and detachable and the ribbon roll up shaft 34 is rotatable, the ribbon roll up shaft 34 is also rotated in the upstream-side roll back direction by roll-back bias force of the ribbon supply shaft 33 toward the upstream side upon attaching the ink ribbon R, and the ink ribbon R is less easily attached. Meanwhile, in the present embodiment, when the ribbon supply shaft 33 is placed at the ribbon replacement position where the ink ribbon R is attachable and detachable, the rotation of the ribbon roll up shaft 34 is also regulated. Thus, it is possible to easily replace the ink ribbon R. Note that even in a case where no back tension mechanism is provided in the ribbon supply shaft 33, it is also possible to prevent that the ribbon roll up shaft 34 is rotated and the ink ribbon R is loosened.

Note that the printer 100 includes a clutch mechanism (not shown) in which the ribbon roll up shaft 34 is rotated upon application of torque which is predetermined torque or more even when the ribbon roll up shaft lock mechanism 60 is in the lock state. Therefore, for example, in a case where large tensile force is applied to the ink ribbon R on the upstream side in the feed direction, the ribbon roll up shaft 34 is rotated even when the ribbon roll up shaft lock mechanism 60 is in the lock state. Thus, it is possible to prevent breakage of the ink ribbon R.

In a state where the lock member 62 is placed at the meshing position, the claw portion 62*a* meshes with the gear 61. However, the claw portion 62*a* may mesh with another gear coupled to the ribbon roll up shaft 34.

As shown in FIG. 2, the base portion 35*a* of the partition member 35 extends to a position where the base portion opposes a reflection sensor 21 provided in the casing 10. Thereby, a feed passage of the print medium M is formed between the reflection sensor 21 and the part of the partition member 35 opposing the reflection sensor 21.

The reflection sensor 21 is a sensor that detects eye marks which are preliminarily printed on a surface of the print medium M opposite to a printed surface at predetermined intervals. Thereby, it is possible to detect a position of the print medium M in the feed direction.

In the present embodiment, by the partition member 35 guiding the print medium M, the print medium M is stably fed within a fixed distance from the reflection sensor 21. Thereby, it is possible to improve detection precision of the reflection sensor 21.

Note that when the printer 100 is brought into a printable state, that is, into the state shown in FIG. 2, the partition member 35 is automatically brought into a state of guiding the print medium M.

In such a way, since the print medium M is guided by the partition member 35, there is no need for separately providing a guide member for feeding the print medium M within a fixed distance from the reflection sensor 21, and a task of inserting the print medium M into the guide member is also not required.

The printer 100 also includes a light transmission sensor 22 that detects the position of the print medium M in the feed direction.

The light transmission sensor 22 is a sensor having a light emitting unit 22*a* which serves as a light emitting portion that emits predetermined light, and a light receiving unit 22*b* which serves as a light receiving portion that receives the light emitted from the light emitting unit 22*a* and outputs an electric signal corresponding to intensity of the received light.

For example, in a case where the print medium M is a label continuous body in which plural labels are continuously temporarily attached to a band-shaped liner sheet at predetermined intervals, there is an only-liner part between two adjacent labels.

Between the label part and the only-liner part, a transmission amount of the light emitted from the light emitting unit 22*a* is different, and hence the intensity of the light received by the light receiving unit 22*b* is changed. Thereby, the light transmission sensor 22 can detect the position of the print medium M in the feed direction.

In the present embodiment, as shown in FIG. 2, the light emitting unit 22*a* is provided on the opposite side of the feed passage of the print medium M in the base portion 35*a*, that is, on the upper surface side of the base portion 35*a*. In the base portion 35*a*, a through hole 35*g* through which the light emitted from the light emitting unit 22*a* passes is formed. Meanwhile, as shown in FIG. 2, the light receiving unit 22*b* is provided on the casing 10 side across the feed passage.

As described above, the task of setting the print medium M in the printer 100 is performed in a state where the cover 11 and the printing unit 30 are swung and the opening portion of the casing 10 is opened (see FIG. 3).

That is, in the present embodiment, it is possible to set the print medium M in the printer 100 in a state where a portion between the light emitting unit 22*a* and the light receiving unit 22*b* is widely opened. Thus, it is possible to easily perform the task of setting the print medium M in the printer 100. Note that the position of the light emitting unit 22*a* may be exchanged with the position of the light receiving unit 22*b*.

The printer 100 activates any of the reflection sensor 21 and the light transmission sensor 22 in accordance with a type of a print medium M to be used, and detects the position of the print medium M in the feed direction.

For example, in a case where a print medium M provided with no eye marks is used, the printer 100 detects the position of the print medium M by the light transmission sensor 22.

The controller 40 is constituted by a microprocessor, storage devices such as a ROM and a RAM, an input/output interface, buses that connect these members, etc. Print data from external computers, signals from the reflection sensor 21, signals from the light transmission sensor 22, etc. are inputted to the controller 40 via the input/output interface.

The controller 40 executes various programs stored in the storage device by the microprocessor, and controls electricity distribution to the heating element of the thermal head 32, electricity distribution to the platen drive motor, etc.

Hereinafter, the configurations, operations, and effects of the present embodiment will be described collectively.

The printer 100 includes the printing portion 15 that performs printing to the print medium M, the ribbon roll up shaft 34 that rolls up the ink ribbon R used in the printing portion 15, the ribbon supply shaft 33 provided movably between the first position and the second position with respect to the ribbon roll up shaft 34, the ribbon supply shaft 33 that holds the ink ribbon R to be supplied to the printing portion 15, and the ribbon supply shaft lock mechanism 50 to be brought into the lock state where the rotation of the ribbon supply shaft 33 is regulated when the ribbon supply shaft 33 is placed at the first position, and into the non-lock state where the rotation of the ribbon supply shaft 33 is permitted when the ribbon supply shaft 33 is placed at the second position.

In the present embodiment, the first position is the ribbon replacement position where the ink ribbon R is attachable to and detachable from the ribbon supply shaft 33, and the second position is the ribbon supply position where the ink ribbon R is supplied to the printing portion 15.

In such a way, at the position where the ink ribbon R is attachable and detachable, the rotation of the ribbon supply shaft 33 is regulated. Thereby, at the time of replacing the ink ribbon R, it is possible to prevent that the ribbon supply shaft 33 is rotated and the ink ribbon R is loosened. Thus, it is possible to easily replace the ink ribbon R. By preventing that the ink ribbon R is loosened, it is possible to prevent useless consumption of the ink ribbon R.

The ribbon supply shaft lock mechanism 50 has the gear 33*a* coupled to the ribbon supply shaft 33, and the lock member 38 to be brought to the meshing position to mesh with the gear 33*a* when the ribbon supply shaft 33 is placed at the first position, and to the non-meshing position where the meshing with the gear 33*a* is released when the ribbon supply shaft 33 is placed at the second position.

According to this, it is possible to easily realize a structure to regulate the rotation of the ribbon supply shaft 33.

The printer 100 includes the swingably provided partition member 35 that partitions the ink ribbon R and the print medium M, the ribbon supply shaft 33 and the lock member 38 are provided in the partition member 35, and the ribbon supply shaft lock mechanism 50 has the guide rail 31*a* in which the lock member 38 slides along the guide surfaces 31*b* and 31*c* following swing of the partition member 35.

According to this, it is possible to easily realize a structure in which a position of the lock member 38 with respect to the ribbon supply shaft 33 is changed following the swing of the partition member 35.

The ribbon supply shaft lock mechanism 50 has the spring 39 serving as a bias member that biases the lock member 38 toward the guide rail 31*a*.

According to this, a following property at the time of the lock member 38 sliding on the guide rail 31*a* is improved. Thus, it is possible to stably move the lock member 38.

The partition member 35 is slidable between the position where the ribbon supply shaft 33 is placed at the first position and the position where the ribbon supply shaft 33 is placed at the second position.

According to this, it is possible to easily realize a structure in which the ribbon supply shaft 33 is moved between the first position and the second position.

The printer 100 includes the swingably provided printing unit 30 having the thermal head 32 that constitutes the printing portion 15, and the ribbon roll up shaft 34, the partition member 35, and the guide rail 31*a* are provided in the main body portion 31 of the printing unit 30.

The printer 100 includes the printing portion 15 that performs printing to the print medium M, the ribbon supply shaft 33 that holds the ink ribbon R to be supplied to the printing portion 15, the ribbon roll up shaft 34 that rolls up the ink ribbon R used in the printing portion 15, the swingably provided partition member 35 that partitions the ink ribbon R and the print medium M, and the ribbon supply shaft lock mechanism 50 that regulates the rotation of the ribbon supply shaft 33. The ribbon supply shaft lock mechanism 50 is switched between the lock state where the rotation of the ribbon supply shaft 33 is regulated and the non-lock state where the rotation of the ribbon supply shaft 33 is permitted in conjunction with the swing actions of the partition member 35.

According to this, at the time of replacing the ink ribbon R, by swinging the partition member 35 to bring the ribbon supply shaft lock mechanism 50 into the lock state, it is possible to prevent that the ribbon supply shaft 33 is rotated and the ink ribbon R is loosened. Thus, it is possible to easily replace the ink ribbon R. There is no need for operating the ribbon supply shaft lock mechanism 50 in order to regulate the rotation of the ribbon supply shaft 33, and it is possible to efficiently perform the task of replacing the ink ribbon R.

The ribbon supply shaft lock mechanism 50 has the gear 33*a* coupled to the ribbon supply shaft 33, and the lock member 38 provided movably between the meshing position to mesh with the gear 33*a* and the non-meshing position where the meshing with the gear 33*a* is released.

According to this, it is possible to easily realize a structure in which the rotation of the ribbon supply shaft 33 is regulated.

The printer 100 includes the printing portion 15 that performs printing to the print medium M, the ribbon supply shaft 33 that holds the ink ribbon R to be supplied to the printing portion 15, and the ribbon roll up shaft 34 that rolls up the ink ribbon R used in the printing portion 15. When the ribbon supply shaft 33 is placed at the ribbon replacement position where the ink ribbon R is attachable and detachable, the rotation of the ribbon supply shaft 33 and the rotation of the ribbon roll up shaft 34 are regulated.

According to this, at the time of replacing the ink ribbon R, it is possible to prevent that the ribbon supply shaft 33 is rotated and the ink ribbon R is loosened. As described above, the back tension mechanism is provided in the ribbon supply shaft 33. Therefore, when the ribbon supply shaft 33 is placed at the ribbon replacement position where the ink ribbon R is attachable and detachable and the ribbon roll up shaft 34 is rotatable, the ribbon roll up shaft 34 is also rotated in the upstream-side roll back direction by roll-back bias force of the ribbon supply shaft 33 toward the upstream side upon attaching the ink ribbon R, and the ink ribbon R is less easily attached. Meanwhile, in the present embodiment, when the ribbon supply shaft 33 is placed at the ribbon replacement position where the ink ribbon R is attachable and detachable, the rotation of the ribbon roll up shaft 34 is also regulated. Thus, it is possible to easily replace the ink ribbon R. Note that even in a case where no back tension mechanism is provided in the ribbon supply shaft 33, it is also possible to prevent that the ribbon roll up shaft 34 is rotated and the ink ribbon R is loosened.

The printer 100 includes the casing 10, the swingably provided cover 11 that covers the opening portion of the casing 10, and the swingably provided printing unit 30 having the thermal head 32 that constitutes the printing portion 15. The ribbon supply shaft 33 and the ribbon roll up shaft 34 are provided in the printing unit 30. The state where the ribbon supply shaft 33 is placed at the ribbon replacement position is the state where the cover 11 is opened, and the state where the open end 30*a* side of the printing unit 30 is separated from the cover 11.

In the printer 100, when the cover 11 is opened, the rotation of the ribbon roll up shaft 34 is regulated.

According to this, when the cover 11 is opened, the rotation of the ribbon roll up shaft 34 is automatically regulated. Thus, there is no need for an operation for regulating the rotation of the ribbon roll up shaft 34.

In the printer 100, when the ribbon supply shaft 33 is placed at the ribbon replacement position, the ribbon supply shaft 33 is exposed to the front side of the printer 100.

According to this, an operator easily visually confirms the ribbon supply shaft 33 and the task of replacing the ink ribbon R is more easily performed.

The printer 100 includes the lock member 38 serving as the first lock member provided movably between the position where the rotation of the ribbon supply shaft 33 is regulated and the position where the rotation is permitted, the lock member 62 serving as the second lock member provided movably between the position where the rotation of the ribbon roll up shaft 34 is regulated and the position where the rotation is permitted, the spring 39 serving as the first bias member that biases the lock member 38 toward the position where the rotation of the ribbon supply shaft 33 is regulated, and the spring 64 serving as the second bias member that biases the lock member 62 toward the position where the rotation of the ribbon roll up shaft 34 is regulated.

According to this, it is possible to easily position the lock member 38 at the position where the rotation of the ribbon supply shaft 33 is regulated, and also to easily position the lock member 62 at the position where the rotation of the ribbon roll up shaft 34 is regulated.

The printer 100 includes the casing 10, the swingably provided cover 11 that covers the opening portion of the casing 10, the printing portion 15 that performs printing to the print medium M, the ribbon supply shaft 33 that holds the ink ribbon R to be supplied to the printing portion 15, the ribbon roll up shaft 34 that rolls up the ink ribbon R used in the printing portion 15, and the swingably provided printing unit 30 having the thermal head 32 that constitutes the printing portion 15. The ribbon supply shaft 33 and the ribbon roll up shaft 34 are provided in the printing unit 30. In a state where the printing unit 30 is accommodated in the cover 11, the rotation of the ribbon supply shaft 33 is permitted. When the open end 30*a* side of the printing unit 30 is separated from the cover 11, and the ribbon supply shaft 33 is placed at the ribbon replacement position where the ink ribbon R is attachable and detachable, the rotation of the ribbon supply shaft 33 is regulated.

According to this, in a state where the open end 30*a* side of the printing unit 30 is separated from the cover 11 and the ink ribbon R is attachable to and detachable from the ribbon supply shaft 33, the rotation of the ribbon supply shaft 33 is regulated. Therefore, at the time of replacing the ink ribbon R, it is possible to prevent that the ribbon supply shaft 33 is rotated and the ink ribbon R is loosened. Thus, it is possible to easily replace the ink ribbon R.

In the printer 100, in a state where the cover 11 is opened, and both in a state where the printing unit 30 is accommodated in the cover 11 and a state where the open end 30*a* side of the printing unit 30 is separated from the cover 11, the rotation of the ribbon roll up shaft 34 is regulated.

According to this, in state where the cover 11 is opened, irrespective of whether the printing unit 30 is accommodated in the cover 11 or the open end 30*a* side is separated from the cover 11, the rotation of the ribbon roll up shaft 34 is regulated. Therefore, at the time of replacing the ink ribbon R or at the time of performing maintenance of the printer 100, it is possible to prevent that the ribbon roll up shaft 34 is rotated and the ink ribbon R is loosened.

Second Embodiment

Figure 7:
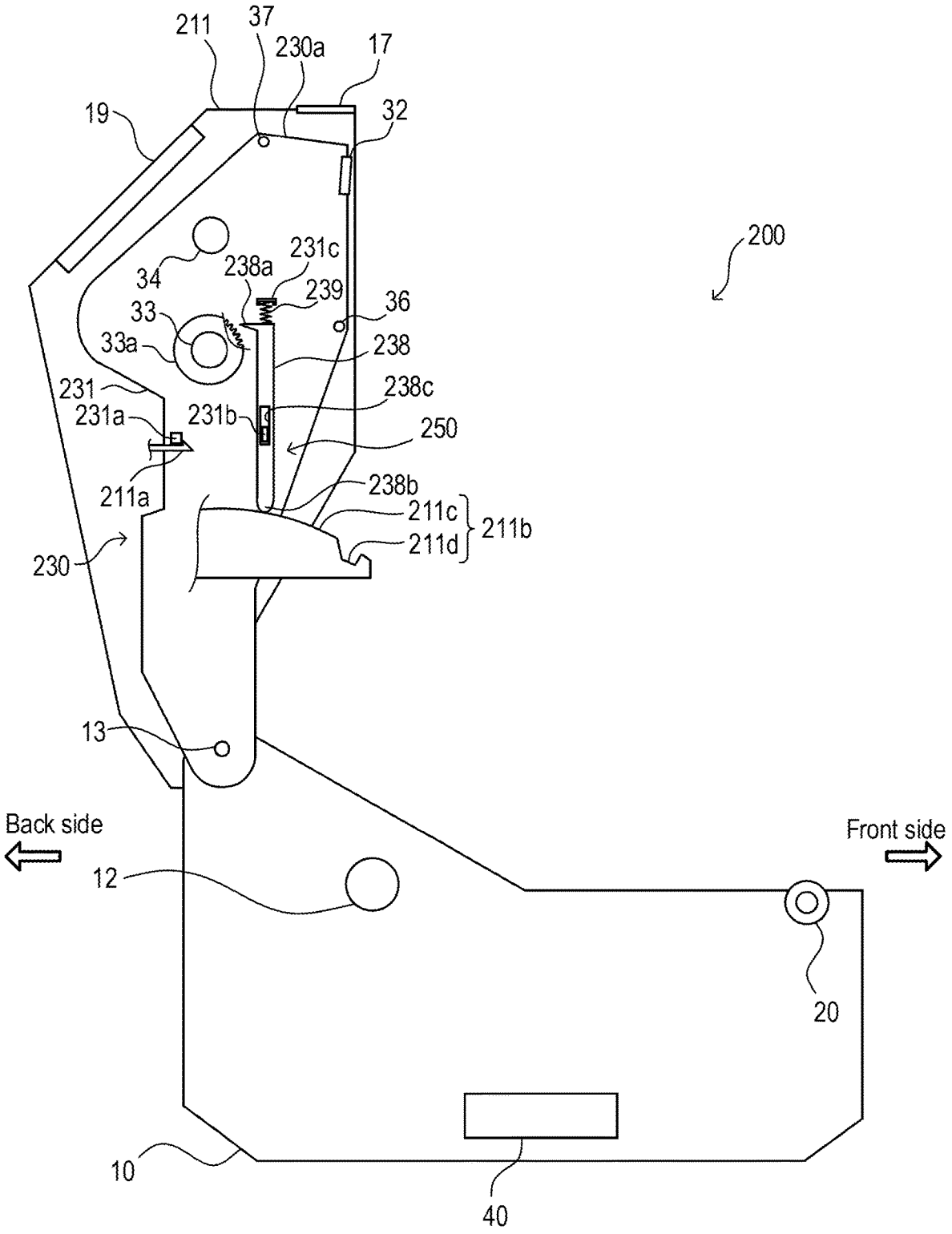
FIG. 7 is a view showing a printer according to a second embodiment of the present invention.
Figure 8:
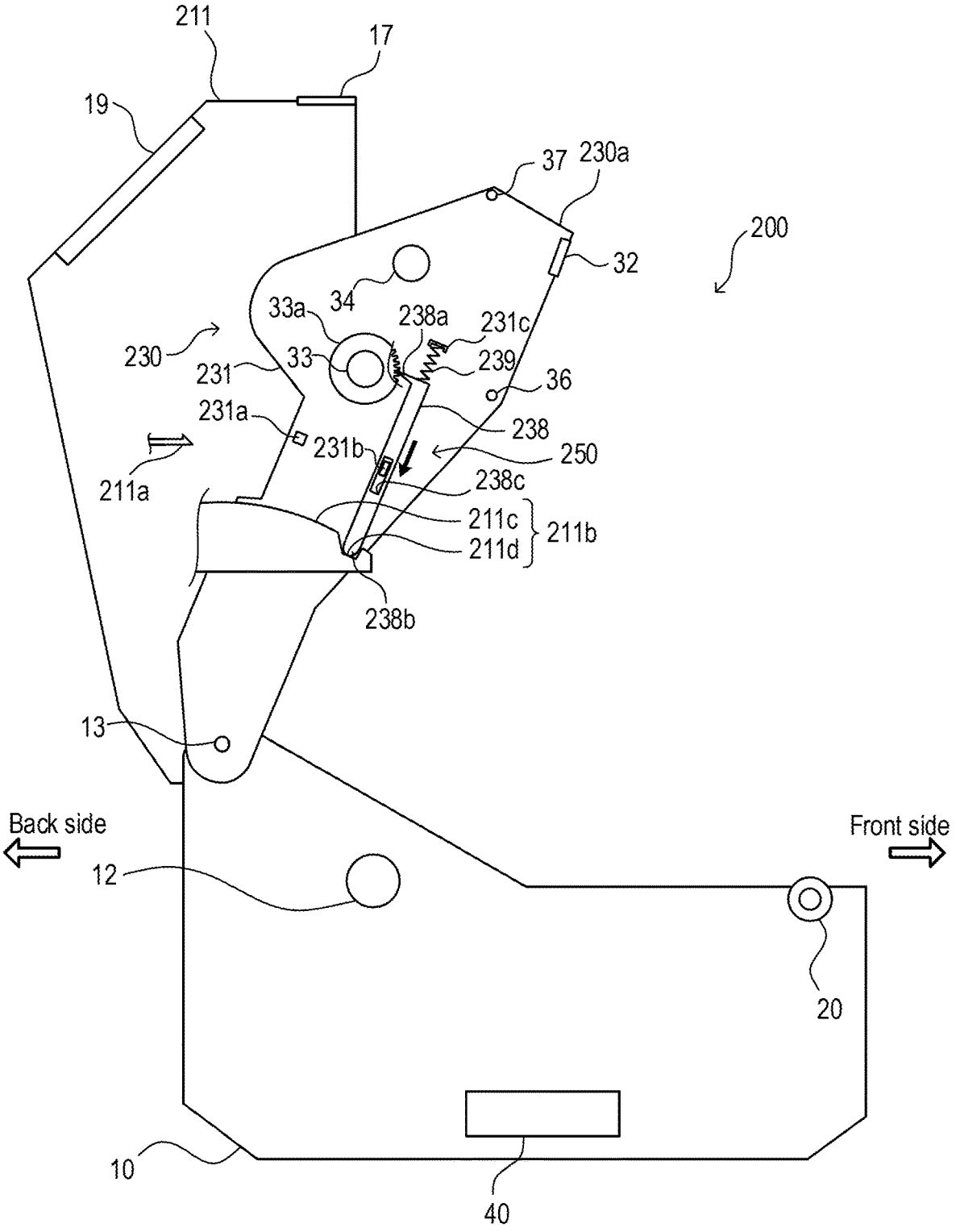
FIG. 8 is a view showing a state where a ribbon supply shaft is placed at a ribbon replacement position.

Successively, a printer 200 according to a second embodiment of the present invention will be described with reference to FIGS. 7 and 8. The printer 200 is different from the printer 100 mainly in a point that a ribbon supply shaft 33 and a ribbon roll up shaft 34 are not moved with respect to each other. Note that in FIGS. 7 and 8, similar configurations to the printer 100 will be given the same reference signs, or will not be described appropriately for easy understanding. The configurations of the printer 200 other than the configurations shown in FIGS. 7 and 8 are the same as the printer 100.

Hereinafter, differences from the first embodiment will be mainly described.

A printing unit 230 of the printer 200 includes a main body portion 231 whose end portion is supported by a support shaft 13 so that the main body portion is swingable, and a thermal head 32 attached to the main body portion 231.

The ribbon supply shaft 33 that holds an ink ribbon R in a roll form and the ribbon roll up shaft 34 that rolls up the used ink ribbon R are provided in the main body portion 231.

An engagement portion 231*a* to be engaged with an engaged portion 211*a* provided in a cover 211 is also provided in the main body portion 231.

As shown in FIG. 7, in a state where the printing unit 230 is placed at an accommodation position where the printing unit 230 is accommodated in the cover 211, the engagement portion 231*a* and the engaged portion 211*a* are engaged with each other. Thereby, the printing unit 230 and the cover 211 are combined with each other.

At the time of performing printing by the printer 200, the cover 211 is in a close state, and the engagement portion 231*a* is engaged with the engaged portion 211*a*. In a state where the cover 211 is closed, the ribbon supply shaft 33 is placed at a ribbon supply position (second position) where the ink ribbon R is supplied to a printing portion 15.

When the cover 211 is opened, the printing unit 230 is swung integrally with the cover 211, and an opening portion of a casing 10 is opened.

Thereby, it is possible to perform settings of a print medium M to the printer 200 and maintenance of portions in the casing 10.

Further, when engagement between the engagement portion 231*a* and the engaged portion 211*a* is released from the state shown in FIG. 7 and the printing unit 230 is swung to the casing 10 side, the printing unit 230 is brought to an open position where the open end 230*a* side is separated from the cover 211 as shown in FIG. 8.

By swinging the printing unit 230 to the casing 10 side with torque which is predetermined torque or more so that the open end 230*a* side is separated from the cover 211, the engagement portion 231*a* and the engaged portion 211*a* are elastically deformed and the engagement between the engagement portion 231*a* and the engaged portion 211*a* is released.

The open position of the printing unit 230 is a position where a swing regulating portion (not shown) provided in the vicinity of the support shaft 13 in the casing 10 and the main body portion 231 are abutted with each other.

Thereby, the ribbon supply shaft 33 is brought to a ribbon replacement position (first position) where the ink ribbon R is attachable and detachable, and it is possible to perform a task of replacing the ink ribbon R.

As shown in FIG. 8, at the ribbon replacement position, the ribbon supply shaft 33 is exposed to the front side of the printer 200. Therefore, an operator easily visually confirms the ribbon supply shaft 33 and the task of replacing the ink ribbon R is more easily performed.

When the printing unit 230 is swung to the casing 10 side with torque which is predetermined torque or more, the swing regulating portion is elastically deformed, the main body portion 231 goes over the swing regulating portion, and the positioning of the printing unit 230 by the swing regulating portion is released.

In such a way, in the present embodiment, by bringing the printing unit 230 to the position where the open end 230*a* side is separated from the cover 211, it is possible to move the ribbon supply shaft 33 to the ribbon replacement position where the ink ribbon R is attachable and detachable.

The printer 200 also includes a ribbon supply shaft lock mechanism 250 to be brought into a lock state where rotation of the ribbon supply shaft 33 is regulated when the ribbon supply shaft 33 is placed at the ribbon replacement position, and into a non-lock state where the rotation of the ribbon supply shaft 33 is permitted when the ribbon supply shaft 33 is placed at the ribbon supply position.

The ribbon supply shaft lock mechanism 250 has a gear 33*a* provided in the ribbon supply shaft 33, a lock member (first lock member) 238 provided movably between a meshing position where a claw portion 238*a* and the gear 33*a* mesh with each other (see FIG. 8) and a non-meshing position where meshing between the claw portion 238*a* and the gear 33*a* is released (see FIG. 7), a guide rail 211*b* provided in the cover 211, the guide rail to be abutted with an end portion 238*b* of the lock member 238, and a spring (first bias member) 239 that biases the lock member 238 toward the guide rail 211*b*.

A long hole 238*c* is formed in the lock member 238, and a rectangular projected portion 231*b* provided in the main body portion 231 is to be fitted into the long hole 238*c*. Thereby, the lock member 238 is slidably supported by the projected portion 231*b*, and becomes movable between the meshing position and the non-meshing position along the longitudinal direction of the long hole 238*c*.

The spring 239 is provided in a compressed state between a sheet portion 231*c* provided in the main body portion 231 and the lock member 238, and biases the lock member 238 toward the guide rail 211*b*. Note that in the present embodiment, the spring 239 is a coil spring. The bias member that biases the lock member 238 may be a plate spring, a torsional spring, rubber, etc.

The guide rail 211*b* has a guide surface 211*c* formed in an arc of a circle whose center is the support shaft 13, and a guide surface 211*d* formed at a position closer to the support shaft 13 than the guide surface 211*c*.

Following the state that the printing unit 230 is swung between the accommodation position (see FIG. 7) and the open position (see FIG. 8), the lock member 238 biased by the spring 239 slides along the guide surfaces 211*c* and 211*d*.

The guide surface 211*c* is formed in an arc of a circle whose center is the support shaft 13. Thus, in a case where the printing unit 230 is swung within a range where the lock member 238 slides along the guide surface 211*c*, a position of the lock member 238 with respect to the gear 33*a* provided in the ribbon supply shaft 33 is not changed. In this case, as shown in FIG. 7, the lock member 238 is maintained at the non-meshing position.

When the printing unit 230 is swung to the open position, the lock member 238 is moved to a position to oppose the guide surface 211*d*. Thereby, as shown by an arrow in FIG. 8, the lock member 238 is biased by the spring 239 and moved to a position where the lock member is abutted with the guide surface 211*d*, and brought to the meshing position where the claw portion 238*a* meshes with the gear 33*a*. In this state, the rotation of the ribbon supply shaft 33 is regulated by the lock member 238.

When the cover 211 is swung in the closing direction, the printing unit 230 is accommodated in the cover 211. Then, the printing unit goes over the swing regulating portion, and is swung together with the cover 211.

At this time, the printing unit 230 is placed at the accommodation position, and the lock member 238 goes up onto the guide surface 211*c* while compressing the spring 239. Thereby, the lock member 238 is brought to the non-meshing position where the meshing between the claw portion 238*a* and the gear 33*a* is released. In this state, the lock member 238 permits the rotation of the ribbon supply shaft 33.

In such a way, in the printer 200, the ribbon supply shaft lock mechanism 250 is brought into the lock state where the rotation of the ribbon supply shaft 33 is regulated when the ribbon supply shaft 33 is placed at the ribbon replacement position, and the ribbon supply shaft lock mechanism 250 is brought into the non-lock state where the rotation of the ribbon supply shaft 33 is permitted when the ribbon supply shaft 33 is placed at the ribbon supply position.

Therefore, at the time of replacing the ink ribbon R, it is possible to prevent that the ribbon supply shaft 33 is rotated in reaction of stoppage of the printing unit 230 at the open position and the ink ribbon R is loosened, and that the ribbon supply shaft 33 is rotated during the task of replacing the ink ribbon R and the ink ribbon R is loosened. Thus, it is possible to easily replace the ink ribbon R.

The ribbon supply shaft lock mechanism 250 is automatically switched between the lock state and the non-lock state in conjunction with the swing actions of the printing unit 230.

Therefore, there is no need for operating the ribbon supply shaft lock mechanism 250 in order to regulate the rotation of the ribbon supply shaft 33, and it is possible to efficiently perform the task of replacing the ink ribbon R.

As shown in FIG. 8, the claw portion 238*a* of the lock member 238 is moved in the tangent line direction in the vicinity of a tangent line of an outer diameter of the gear 33*a* and meshes with the gear 33*a*.

Note that as well as the ribbon supply shaft lock mechanism 50 of the first embodiment, the gear to mesh with the claw portion 238*a* of the lock member 238 may be a gear coupled to the ribbon supply shaft 33 other than the gear 33*a*.

As well as the printer 100, the printer 200 also includes a ribbon roll up shaft lock mechanism 60 to be brought into a lock state where rotation of the ribbon roll up shaft 34 is regulated when the cover 211 is opened. In a state where the cover 211 is opened, and both in a state where the printing unit 230 is accommodated in the cover 211 and a state where the open end 230*a* side of the printing unit 230 is separated from the cover 211, the rotation of the ribbon roll up shaft 34 is regulated.

Therefore, when the ribbon supply shaft 33 is placed at the ribbon replacement position where the ink ribbon R is attachable and detachable, the rotation of the ribbon supply shaft 33 and the rotation of the ribbon roll up shaft 34 are regulated.

Figure 9:
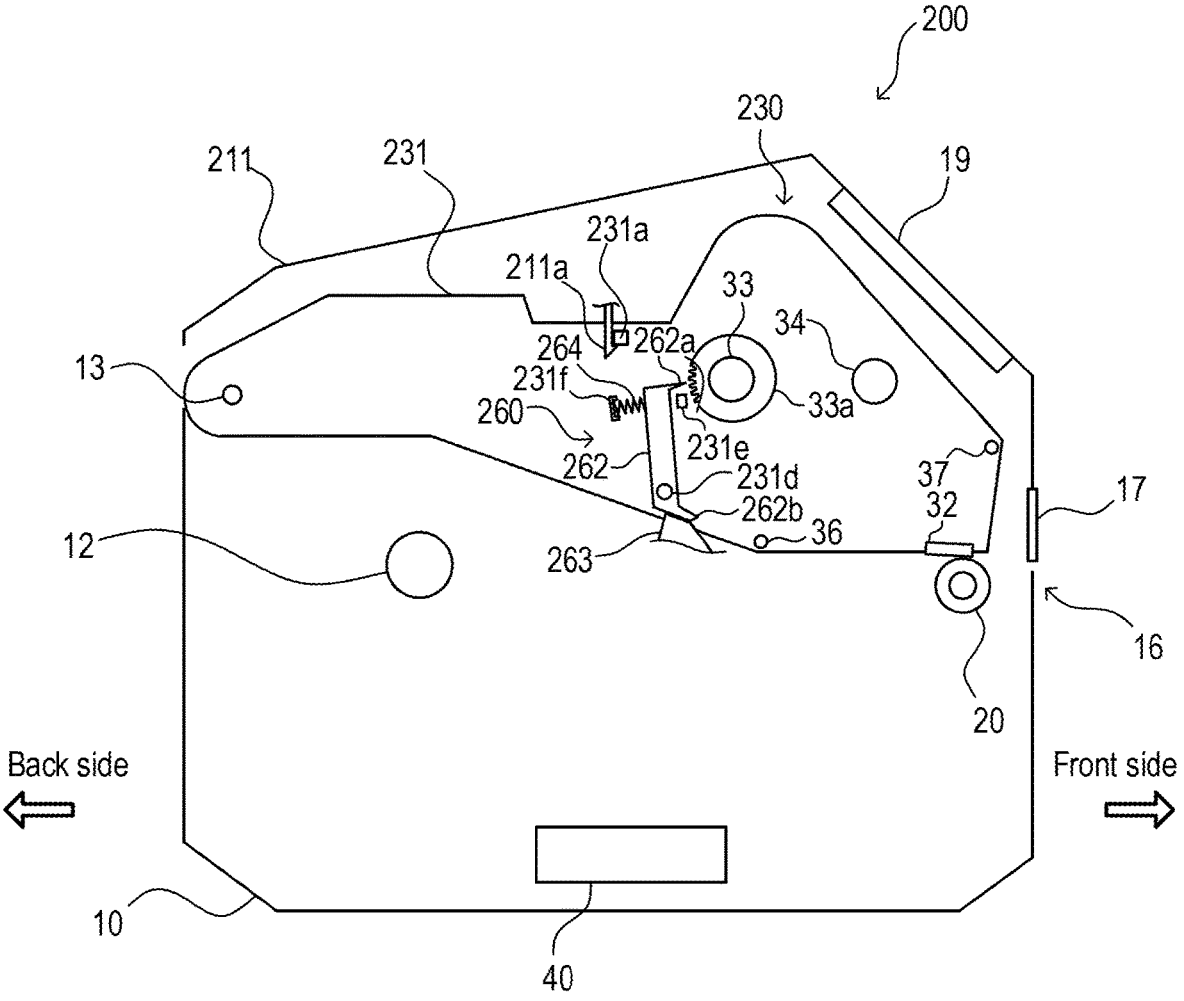
FIG. 9 is a view showing a modified example of a ribbon supply shaft lock mechanism.

Note that as described above, in the printer 200, the ribbon supply shaft 33 is provided in the main body portion 231 of the printing unit 230. Therefore, instead of the ribbon supply shaft lock mechanism 250, a ribbon supply shaft lock mechanism 260 having a similar structure to the ribbon roll up shaft lock mechanism 60 may be provided as shown in FIG. 9.

The ribbon supply shaft lock mechanism 260 has the gear 33*a* provided in the ribbon supply shaft 33, a lock member (first lock member) 262 supported by a support shaft 231*d* provided in the main body portion 231 of the printing unit 230, the lock member being provided turnably between a meshing position where a claw portion 262*a* and the gear 33*a* mesh with each other and a non-meshing position where meshing between the claw portion 262*a* and the gear 33*a* is released (see FIG. 9), a first positioning portion 263 provided on the casing 10 side, the first positioning portion to be abutted with a projected portion 262*b* of the lock member 262 to position the lock member 262 at the non-meshing position, a second positioning portion 231*e* provided in the main body portion 231 of the printing unit 230, the second positioning portion to be abutted with the lock member 262 to position the lock member 262 at the meshing position, and a spring (first bias member) 264 that biases the lock member 262 in the direction in which the lock member is turned from the non-meshing position toward the meshing position.

The spring 264 is provided in a compressed state between a sheet portion 231*f* provided in the main body portion 231 of the printing unit 230 and the lock member 262, and biases the lock member 262 in the direction in which the lock member is turned from the non-meshing position toward the meshing position. Note that in the present embodiment, the spring 264 is a coil spring. The bias member that biases the lock member 262 may be a plate spring, a torsional spring, rubber, etc.

In a case where the ribbon supply shaft lock mechanism 260 having a similar structure to the ribbon roll up shaft lock mechanism 60 is adopted, in the printer 200, the rotation of the ribbon supply shaft 33 and the rotation of the ribbon roll up shaft 34 are regulated when the cover 211 is opened.

In this case, the lock member 262 of the ribbon supply shaft lock mechanism 260 and the lock member 62 of the ribbon roll up shaft lock mechanism 60 may work in conjunction with each other by a link mechanism.

According to this, either the spring 264 of the ribbon supply shaft lock mechanism 260 or the spring 64 of the ribbon roll up shaft lock mechanism 60 is not required.

Hereinafter, the configurations, operations, and effects of the present embodiment will be described collectively.

The printer 200 includes the printing portion 15 that performs printing to the print medium M, the ribbon supply shaft 33 that holds the ink ribbon R to be supplied to the printing portion 15, and the ribbon roll up shaft 34 that rolls up the ink ribbon R used in the printing portion 15. When the ribbon supply shaft 33 is placed at the ribbon replacement position where the ink ribbon R is attachable and detachable, the rotation of the ribbon supply shaft 33 and the rotation of the ribbon roll up shaft 34 are regulated.

According to this, at the time of replacing the ink ribbon R, it is possible to prevent that the ribbon supply shaft 33 is rotated and the ink ribbon R is loosened. As described above, the back tension mechanism is provided in the ribbon supply shaft 33. Therefore, when the ribbon supply shaft 33 is placed at the ribbon replacement position where the ink ribbon R is attachable and detachable and the ribbon roll up shaft 34 is rotatable, the ribbon roll up shaft 34 is also rotated in the upstream-side roll back direction by roll-back bias force of the ribbon supply shaft 33 toward the upstream side upon attaching the ink ribbon R, and the ink ribbon R is less easily attached. Meanwhile, in the present embodiment, when the ribbon supply shaft 33 is placed at the ribbon replacement position where the ink ribbon R is attachable and detachable, the rotation of the ribbon roll up shaft 34 is also regulated. Thus, it is possible to easily replace the ink ribbon R. Note that even in a case where no back tension mechanism is provided in the ribbon supply shaft 33, it is also possible to prevent that the ribbon roll up shaft 34 is rotated and the ink ribbon R is loosened.

The printer 200 includes the casing 10, the swingably provided cover 211 that covers the opening portion of the casing 10, and the swingably provided printing unit 230 having the thermal head 32 that constitutes the printing portion 15. The ribbon supply shaft 33 and the ribbon roll up shaft 34 are provided in the printing unit 230. The state where the ribbon supply shaft 33 is placed at the ribbon replacement position is the state where the cover 211 is opened, and the state where the open end 230*a* side of the printing unit 230 is separated from the cover 211.

In the printer 200, when the cover 211 is opened, the rotation of the ribbon roll up shaft 34 is regulated.

According to this, when the cover 211 is opened, the rotation of the ribbon roll up shaft 34 is automatically regulated. Thus, there is no need for an operation for regulating the rotation of the ribbon roll up shaft 34.

In the printer 200, when the ribbon supply shaft 33 is placed at the ribbon replacement position, the ribbon supply shaft 33 is exposed to the front side of the printer 200.

According to this, an operator easily visually confirms the ribbon supply shaft 33 and the task of replacing the ink ribbon R is more easily performed.

The printer 200 includes the lock member 238 serving as the first lock member provided movably between the position where the rotation of the ribbon supply shaft 33 is regulated and the position where the rotation is permitted, the lock member 62 serving as the second lock member provided movably between the position where the rotation of the ribbon roll up shaft 34 is regulated and the position where the rotation is permitted, the spring 239 serving as the first bias member that biases the lock member 238 toward the position where the rotation of the ribbon supply shaft 33 is regulated, and the spring 64 serving as the second bias member that biases the lock member 62 toward the position where the rotation of the ribbon roll up shaft 34 is regulated.

According to this, it is possible to easily position the lock member 238 at the position where the rotation of the ribbon supply shaft 33 is regulated, and also to easily position the lock member 62 at the position where the rotation of the ribbon roll up shaft 34 is regulated.

The printer 200 includes the casing 10, the swingably provided cover 211 that covers the opening portion of the casing 10, the printing portion 15 that performs printing to the print medium M, the ribbon supply shaft 33 that holds the ink ribbon R to be supplied to the printing portion 15, the ribbon roll up shaft 34 that rolls up the ink ribbon R used in the printing portion 15, and the swingably provided printing unit 230 having the thermal head 32 that constitutes the printing portion 15. The ribbon supply shaft 33 and the ribbon roll up shaft 34 are provided in the printing unit 230. In a state where the printing unit 230 is accommodated in the cover 211, the rotation of the ribbon supply shaft 33 is permitted. When the open end 230*a* side of the printing unit 230 is separated from the cover 211, and the ribbon supply shaft 33 is placed at the ribbon replacement position where the ink ribbon R is attachable and detachable, the rotation of the ribbon supply shaft 33 is regulated.

According to this, in a state where the open end 230*a* side of the printing unit 230 is separated from the cover 211 and the ink ribbon R is attachable to and detachable from the ribbon supply shaft 33, the rotation of the ribbon supply shaft 33 is regulated. Therefore, at the time of replacing the ink ribbon R, it is possible to prevent that the ribbon supply shaft 33 is rotated and the ink ribbon R is loosened. Thus, it is possible to easily replace the ink ribbon R.

In the printer 200, in a state where the cover 211 is opened, and both in a state where the printing unit 230 is accommodated in the cover 211 and a state where the open end 230*a* side of the printing unit 230 is separated from the cover 211, the rotation of the ribbon roll up shaft 34 is regulated.

According to this, in state where the cover 211 is opened, irrespective of whether the printing unit 230 is accommodated in the cover 211 or the open end 230*a* side is separated from the cover 211, the rotation of the ribbon roll up shaft 34 is regulated. Therefore, at the time of replacing the ink ribbon R or at the time of performing maintenance of the printer 200, it is possible to prevent that the ribbon roll up shaft 34 is rotated and the ink ribbon R is loosened.

The embodiments of the present invention are described above. However, each of the above embodiments only shows one of application examples of the present invention and there is no intention to limit the technical scope of the present invention to the specific configurations of the embodiments described above.

The configurations of the embodiments described above can be appropriately combined for use.

The present application makes a priority claim based on Japanese Patent Application No. 2018-133724 filed in the Japan Patent Office on Jul. 13, 2018, and the entire disclosure of this application is incorporated herein by reference.

The invention claimed is:

1. A printer comprising:

a casing;

a cover provided swingably, the cover covering an opening portion of the casing;

a printing unit provided swingably and having a thermal head configured to print on a print medium, the printing unit being configured to have a state where the printing unit is accommodated in the cover, and a state where an open end side of the printing unit is separated from the cover;

a ribbon supply shaft provided in the printing unit and configured to hold an ink ribbon to be supplied to the thermal head, rotate, in response to the printing unit being in the state where the printing unit is accommodated in the cover, and have a ribbon replacement position where the ink ribbon is attachable and detachable and rotation of the ribbon supply shaft is prevented, in response to the printing unit being in the state where the open end side of the printing unit is separated from the cover; and a ribbon roll up shaft provided in the printing unit and configured to roll up the ink ribbon used by the thermal head.

2. The printer according to claim 1, wherein in a state where the cover is opened, and both in a state where the printing unit is accommodated in the cover and a state where the open end side of the printing unit is separated from the cover, rotation of the ribbon roll up shaft is prevented.

3. The printer according to claim 2, wherein when the cover is opened, the rotation of the ribbon roll up shaft is prevented.

4. The printer according to claim 3, wherein when the ribbon supply shaft is placed at the ribbon replacement position, the ribbon supply shaft is exposed to the front side of the printer.

5. The printer according to claim 4, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

6. The printer according to claim 3, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

7. The printer according to claim 2, wherein when the ribbon supply shaft is placed at the ribbon replacement position, the ribbon supply shaft is exposed to the front side of the printer.

8. The printer according to claim 7, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

9. The printer according to claim 7, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

10. The printer according to claim 1, wherein when the cover is opened, the rotation of the ribbon roll up shaft is prevented.

11. The printer according to claim 10, wherein when the ribbon supply shaft is placed at the ribbon replacement position, the ribbon supply shaft is exposed to the front side of the printer.

12. The printer according to claim 11, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

13. The printer according to claim 10, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

14. The printer according to claim 1, wherein when the ribbon supply shaft is placed at the ribbon replacement position, the ribbon supply shaft is exposed to the front side of the printer.

15. The printer according to claim 14, comprising:

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

16. A printer comprising:

a casing;

a cover provided swingably, the cover covering an opening portion of the casing;

a printing unit provided swingably and having a thermal head configured to print on a print medium, the printing unit being configured to have a state where the printing unit is accommodated in the cover, and a state where an open end side of the printing unit is separated from the cover:

a ribbon supply shaft provided in the printing unit and configured to hold an ink ribbon to be supplied to the thermal head, rotate, in response to the printing unit being in the state where the printing unit is accommodated in the cover, and have a ribbon replacement position where the ink ribbon is attachable and detachable and rotation of the ribbon supply shaft is prevented, in response to the printing unit being in the state where the open end side of the printing unit is separated from the cover; and a ribbon roll up shaft provided in the printing unit and configured to roll up the ink ribbon used by the thermal head;

a first lock member provided movably between a position where the rotation of the ribbon supply shaft is prevented and a position where the rotation is permitted;

a second lock member provided movably between a position where rotation of the ribbon roll up shaft is prevented and a position where the rotation is permitted;

a first bias member biasing the first lock member toward the position where the rotation of the ribbon supply shaft is prevented; and a second bias member biasing the second lock member toward the position where the rotation of the ribbon roll up shaft is prevented.

* * * * *